United States Patent [19]

Culley, Jr.

[11] 4,312,609

[45] Jan. 26, 1982

[54] MINE ROOF SUPPORT SYSTEM

[76] Inventor: Donnell H. Culley, Jr., P.O. Box 118, Whitesburg, Tenn. 37891

[21] Appl. No.: 165,203

[22] Filed: Jul. 1, 1980

[51] Int. Cl.[3] ..... E21D 15/00

[52] U.S. Cl. ..... 405/291; 175/219

[58] Field of Search ..... 405/290–302, 405/303; 299/31, 33, 10, 11; 175/219, 213; 173/23, 22; 280/150 F, 150 R, 150.5, 156

[56] References Cited

U.S. PATENT DOCUMENTS

| | | | |
|---|---|---|---|
| Re. 28,707 | 2/1976 | Swoager | 405/291 |
| 2,752,757 | 7/1956 | Joy | 405/298 |
| 2,795,935 | 6/1957 | Fitzgerald | 405/300 |
| 3,534,560 | 10/1970 | Rieschel | 405/290 |
| 4,079,792 | 3/1978 | Paul et al. | 175/219 |

*Primary Examiner*—Dennis L. Taylor
*Attorney, Agent, or Firm*—Woodford R. Thompson, Jr.

[57] ABSTRACT

A mine roof support system having sets of laterally spaced pairs of elongated support members adapted to be moved into and out of abutting relation with a mine roof. Wheel supported frames extend between and connect adjacent end portions of each pair of support members with adjacent wheel supported frames at the ends of the support members being in spaced tandem relation and connected to each other by connector members. Extensible prop members are connected to and move the wheel supported frames and the elongated support members connected thereto selectively toward and away from the mine roof.

15 Claims, 8 Drawing Figures

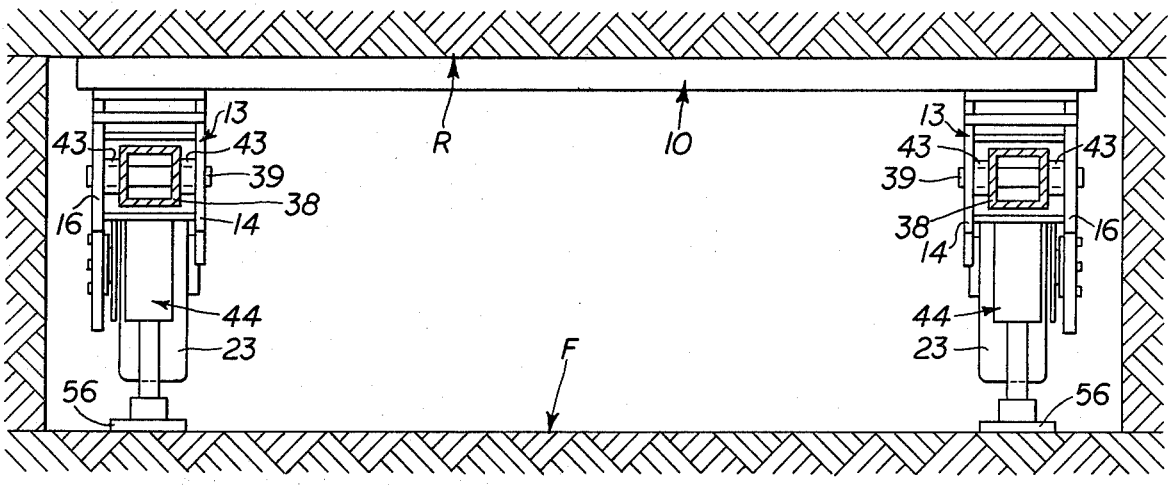
FIG. 3
FIG. 4
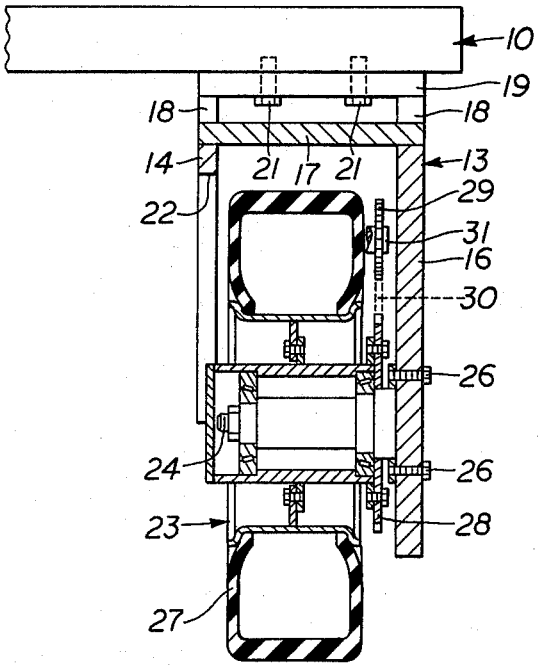
FIG. 5
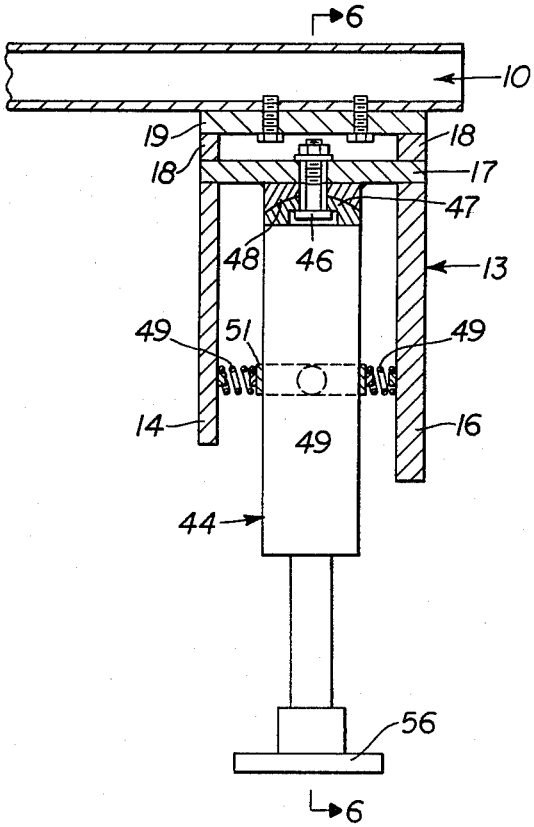

MINE ROOF SUPPORT SYSTEM

BACKGROUND OF THE INVENTION

This invention relates to a mine roof support system and more particularly to such a system which has elongated support members adapted to be moved into and out of abutting relation with a mine roof.

Heretofore in the art to which my invention relates, many systems have been proposed in the mining of coal and the like wherein temporary support means has been provided for the mine roof above a mining machine so that the roof is supported as the mining machine, such as a continuous miner, is operated between the mine face and the section of the mine roof supported by the usual roof bolts, timbers or the like. Such temporary means for supporting mine roofs must be operable to support the roof as the continuous mining machine advances into the mine face so as to prevent interruption of the mining operation, which would occur where it is necessary to disassemble and then reassemble the temporary roof supports each time the temporary roof support is advanced.

Conventional types of mine roof support systems are shown in U.S. Pat. No. 2,795,935, No. 2,795,936, No. 3,890,792, No. 3,534,560 and No. 4,143,991. The apparatus disclosed in the latter patent includes a plurality of truss members with each truss member being supported by a pair of prop members which are movable in a direction either toward or away from the mine face relative to the other pairs of prop members by telescoping devices that interconnect the prop members. Such apparatus is very difficult to stabilize and at the same time a considerable amount of time and effort is incurred in changing the relative positions of the individual pairs of prop members as each elongated roof engaging truss member is moved toward or away from the mine face.

SUMMARY OF THE INVENTION

In accordance with my invention, I provide a mine roof support system having sets of laterally spaced pairs of elongated support members which are adapted to be positioned abutting a mine roof. Adjacent end portions of each pair of elongated support members are connected by a wheel supported frame with adjacent wheel supported frames at the ends of the support members being in spaced tandem relation to each other and connected to each other by elongated connector members. Each wheel supported frame carries extensible prop members which move the wheel supported frame and the elongated support members connected thereto selectively toward and away from the mine roofs.

Each wheel supported frame carries at least one supporting wheel which is adapted for movement on the mine floor so that the mine roof support system moves as a unit as it advances toward or moves away from the mine face, thus eliminating the necessity of having to move the individual roof support members separately toward or away from the mine face. Also, adjacent wheel supported frames at the ends of the elongated support members are pivotally connected to the connector member extending therebetween so that adjacent wheel supported frames are articulated for vertical movement relative to each other to thus place the elongated support members in position to conform to the adjacent surface of the mine roof.

Each wheel supported frame is pivotally connected to upper portions of extensible prop members which are located subjacent the point of connection of the wheel supported frame to the elongated support member carried thereby. Accordingly, each extensible prop is adapted for a limited amount of pivotal movement relative to its wheel supported frame. To limit pivotal movement between each prop member and its wheel supported frame, I provide resilient means therebetween which urges the prop member toward a vertical position. Each extensible prop member is also provided with a convexly curved upper bearing surface which engages a concave bearing surface carried by its wheel supported frame to further facilitate relative movement between each prop member and its associated wheel supported frame.

DESCRIPTION OF THE DRAWINGS

Apparatus embodying features of my invention is illustrated in the accompanying drawings, forming a part of this application, in which:

FIG. 3 is a sectional view taken generally along the line 3—3 of FIG. 2;

FIG. 4 is a vertical sectional view taken generally along the line 4—4 of FIG. 2;

FIG. 5 is a sectional view taken generally along the line 5—5 of FIG. 2;

DETAILED DESCRIPTION

Figure 1:
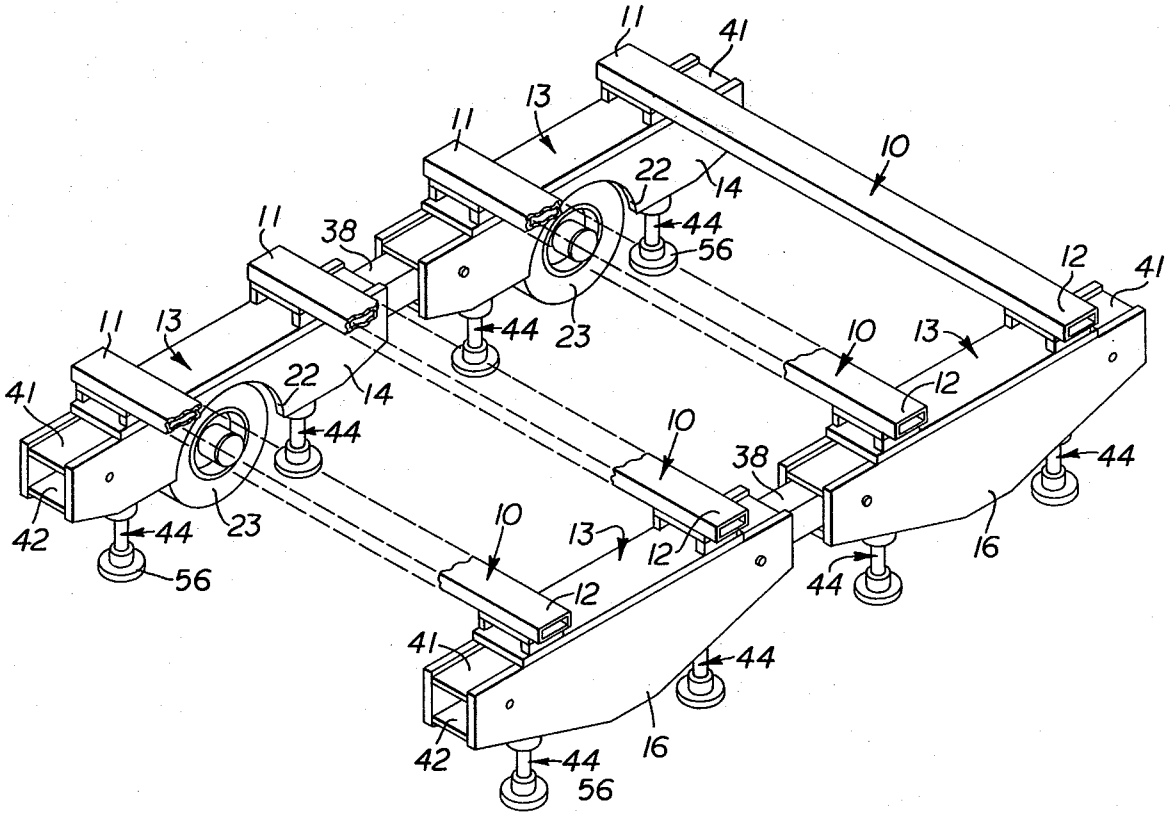
FIG. 1 is a perspective view of my improved mine roof support system, partly broken away.
Figure 2:
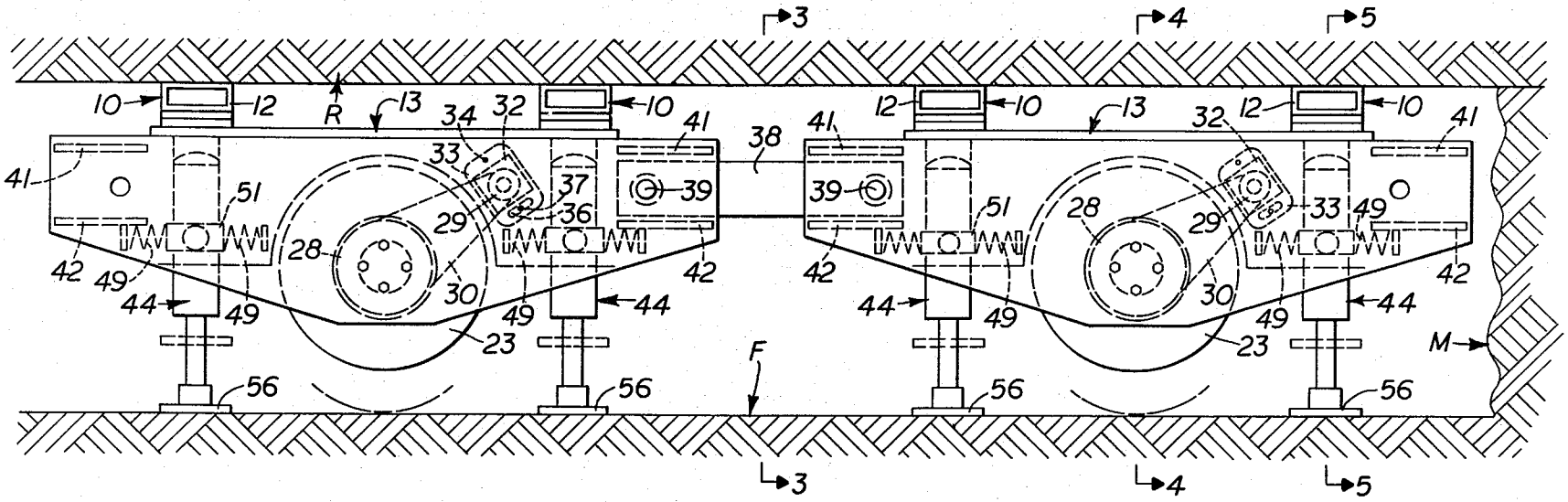
FIG. 2 is a side elevational view showing the mine roof support system in the operative position adjacent the face of a mine.

Referring now to the drawings for a better understanding of my invention, I show two sets of laterally spaced pairs of elongated support members 10 which are adapted to be positioned abutting a mine roof with each elongates support member 10 having a first end portion 11 and a second end portion 12. An elongated wheel supported frame 13 extends between and connects the adjacent first end portion 11 of each pair of elongated support members 10 to each other with adjacent wheel supported frames 13 connecting the first end portion 11 being in spaced tandem relation to each other, as shown. In like manner, a wheel supported frame 13 extends between and connects the second end portions 12 of each pair of elongated support members 10 to each other with adjacent wheel supported frames connecting such second end portions 12 being in spaced tandem relation to each other, as shown in FIGS. 1 and 2.

Each wheel supported frame 13 comprises depending, inner and outer side walls 14 and 16, respectively, which are secured at their upper ends to a transverse plate 17 which in turn is secured to spacer elements 18 which are secured to and depend from a transverse plate 19. Suitable retainer bolts 21 secure each transverse plate 19 to its associated elongated support member 10, as shown in FIG. 4. As shown in FIGS. 1 and 4, each inner wall 14 is provided with a cut-away portion 22 for receiving a supporting wheel indicated generally at 23. The supporting wheel 23 is mounted on a supporting spindle 24 which in turn is secured to the depending wall 16 by suitable retainer bolts 26. Also, a conventional, resilient, pneumatic tire 27 is mounted on the wheel 23 for movement on the mine floor, indicated at F.

Each wheel unit 23 carries a sprocket 28 which is operatively connected to a drive sprocket 29 by a drive chain 30. The sprocket 29 is mounted on a shaft 31 for a hydraulic motor 32. The sprocket 29 and the hydraulic motor 32 are carried by a support bracket 33 which is supported at one side by a pivot pin 34. The other side of the bracket 33 is provided with an arcuate slot 36 therein for receiving a retaining bolt 37 whereby the support bracket 33 may be locked at selected positions to vary the tension on the sprocket chain 30.

A connector member 38 extends between and operatively connects in spaced relationship the adjacent wheel supported frames 13 which connect the first end portions 11 and the adjacent wheel supported frames 13 which connect the second end portions 12 whereby the sets of laterally spaced pairs of elongated support members are adapted to move as a unit as the continuous mining machine advances in the mine passageway. That is, as the continuous miner advances and dislodges material from the mine face M, the sets of laterally spaced pairs of elongated support members are moved periodically forward as a unit with the continuous miner to provide substantially uninterrupted roof support for the continuous miner as it operates at the mine face. The connector member 38 is shown as being in the form of an elongated bar-like member which is pivotally connected by suitable pivot pins 39 adjacent opposite ends thereof to adjacent end portions of the wheel supported frames 13, as shown in FIGS. 1 and 2. Accordingly, the adjacent wheel supported frames 13 pivotally connected by the bar-like member 38 are articulated for vertical movement relative to each other to thus place the elongated support members 10 in position to conform to the adjacent surface or contour of a mine roof.

As shown in FIGS. 1 and 2, upper and lower stop members 41 and 42, respectively, are carried by each wheel supported frame 13 at opposite sides of the elongated bar-like member 38 in position to limit relative vertical movement between the wheel supported frame and the elongated bar-like member. Also, as shown in FIG. 3, the depending side walls 14 and 16 of each wheel supported frame 13 is spaced laterally from each other for receiving an adjacent end of at least one bar-like member 38. Suitable spacer members 43 are interposed between the bar-like member 38 and the adjacent sides of the depending side walls 14 and 16, as shown in FIG. 3.

Figure 6:
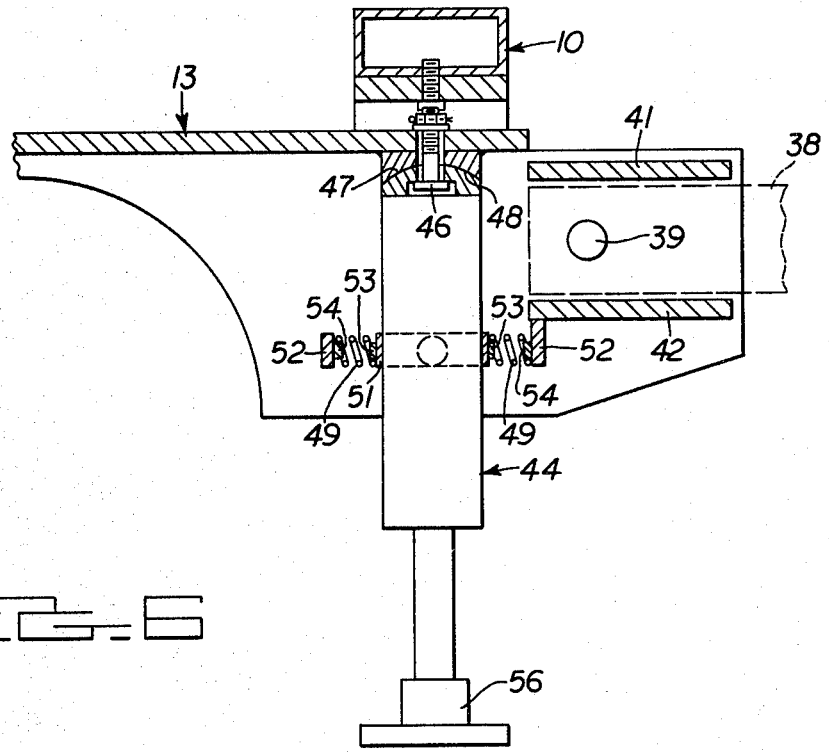
FIG. 6 is a sectional view taken generally along the line 6—6 of FIG. 5.
Figure 8:
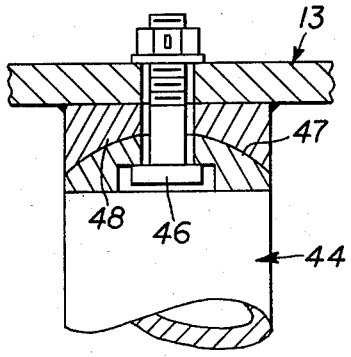

Extensible prop members 34 are carried by the wheel supported frames 13 whereby the pair of elongated support members connected thereto are moved into and out of engagement with the mine roof indicated generally at R. Each extensible prop member 44 is shown as being in the form of a depending jack member which is pivotally connected at its upper end to its associated wheel supported frame by a pivot pin 46. As shown in FIGS. 5, 6 and 8 the pivot connection between each prop member 44 and its wheel supported frame 13 is in the form of a loose connection so that the lower end of each prop member is adapted for movement relative to a vertical position to eliminate stresses in the connection between the prop member 44 and the wheel supported frame as the elongated support members move into engagement with the mine roof. As shown in FIG. 2, each extensible prop member 44 is pivotally connected to its wheel supported frame subjacent the point of connection of its wheel supported frame to an elongated support member 10 whereby each elongated support member 10 is supported directly above an extensible prop member 44.

As shown in FIG. 5, each extensible prop member 44 has a convexly curved upper bearing surface 47 which engages a concave bearing surface 48 carried by its wheel supported frame 13. Preferably, the convexly curved upper bearing surface 47 is in the shape of a segment of a sphere whereby the upper end of the extensible prop member 44 is adapted for movement relative to the concave bearing surface 48. To limit the amount of pivotal movement between the extensible prop member 44 and its wheel supported frame 13, I mount resilient means, such as compression springs 49 at four sides of each extensible prop member 44, as shown in FIGS. 2 and 6. Each compression spring 49 may be positioned between an annular collar 51 which surrounds the extensible prop member 44 and spring abutments 52 which are carried by the wheel supported frame 13, as shown in FIG. 6. The outer surface of the annular collar 51 is provided with angularly spaced projections 53 which extend inwardly of the springs 49 to hold the same in place. In a similar manner, inwardly projecting members 54 are carried by the inner surfaces of the spring abutments 52 in position to enter the adjacent end of the compression spring 49 to thus retain the same in place. By providing resilient springs 49 which engage four sides of the extensible prop member 44, the prop member is urged toward a vertical position. It will be understood that the extensible prop member may be in the form of a conventional type hydraulic jack having a foot portion 56 which is adapted to engage the floor F of the mine, as shown in FIG. 2.

Figure 7:
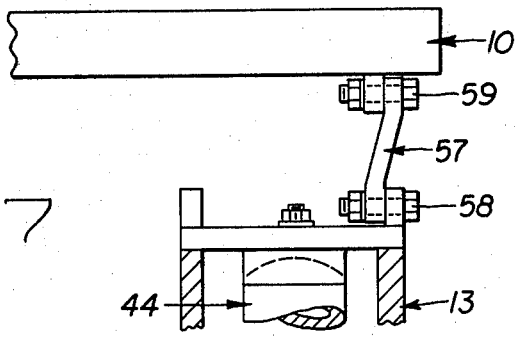
FIG. 7 is a fragmental view showing an extensible support member which may be employed with my mine roof support system to vary the effective height of each elongated support member relative to its wheel supported frame; and, FIG. 8 is an enlarged, fragmental view showing the pivotal connection between the prop member and the wheel supported frame.

Referring now to FIG. 7 of the drawings, I show a slightly modified form of my invention in which the elongated support member 10 is connected to its wheel supported frame 13 by an extension support member 57 so that the effective height of the elongated support member 10 relative to its wheel supported frame 13 may be varied. Each extension support member 57 is in the form of an upstanding plate-like member which is connected adjacent its lower end to its wheel supported frame by bolts 58. The upper end of the extension support member is connected by bolts 59 to its associated elongated support member 10, as shown. Accordingly, to vary the effective height of the elongated support member 10 relative to its wheel supported frame 13, the extension support member 57 is merely installed between the elongated support member 10 and its wheel supported frame 13.

From the foregoing description, the operation of my improved mine roof support system will be readily understood. To support the mine roof R, the entire unit is supported by the supporting wheels 23 as it is moved to the position shown in FIG. 2 adjacent the mine face, indicated at M. That is, the entire unit is moved to a position to provide a continuous support for the roof R between the area adjacent the mine face M and the last section of the mine passageway that is supported by the usual roof support members such as roof bolts. With the entire unit in a position adjacent the mine face M, the hydraulic jacks 44 are extended whereby the pairs of elongated support members 10 carried by the wheel supported frames are moved into engagement with the mine roof R, as shown in FIG. 2. In view of the fact that the hydraulic jack members 44 are of a conventional type, no further description of the operation of the jack members is deemed necessary. Since the entire apparatus is moved periodically as a unit, the hydraulic jack members 44 are operable in unison to lift all of the elongated support members 10 at the same time, thus greatly reducing the amount of time required to change the position of the apparatus as the continuous miner advances in the usual manner to dislodge material from the mine face M. Instead of moving each elongated support member separately in the mine passageway, as has been the practice heretofore, I move the entire apparatus, including the elongated support members 10, forwardly as a unit each time there is any advancement of the apparatus relative to the mine face M. Accordingly, the advancement of my improved roof support system does not require the elongated support members to be lowered from engagement with the mine roof separately and then advanced separately toward the mine face, thus requiring separate removal and advancement of each elongated support member as the continuous miner advances.

From the foregoing, it will be seen that I have devised an improved mine roof support system. By moving the entire system as a unit, I provide protection for the operator all the way from the mine face M to the section in the mine passageway which is supported by conventional roof support devices. Also, by moving the entire system as a unit, the system is advanced or removed with a minimum of time and effort due to the fact that each elongated support member 10 does not have to be moved toward or away from the mine roof separately prior to movement toward or away from the mine face M. Also, by pivotally connecting the adjacent wheel supported frames to each other, the wheel supported frames are articulated for vertical movement relative to each other to thus place the elongated support members in position to conform to the adjacent surface of the mine roof as the wheels 23 support the apparatus from the mine floor F. Furthermore, by providing wheel supported frames having resilient tires adapted for movement on the mine floor, the apparatus may be moved quickly from one location to another at any desired speed.

While I have shown my invention in but two forms, it will be obvious to those skilled in the art that it is not so limited, but is susceptible of various other changes and modifications without departing from the spirit thereto.

What I claim is:

1. A mine roof support system comprising, (a) at least two sets of laterally spaced pairs of elongated support members adapted to be positioned abutting a mine roof with each said elongated support member having first and second end portions, (b) a wheel supported frame extending between and connecting said first end portions of each pair of elongated support members to each other with adjacent wheel supported frames connecting said first end portions of each said set of laterally spaced pairs of elongated support members being in spaced tandem relation to each other, (c) a wheel supported frame extending between and connecting said second end portions of each pair of elongated support members to each other with adjacent wheel supported frames connecting said second end portions of each said set of laterally spaced pairs of elongated support members being in spaced tandem relation to each other, (d) connector means extending between and operatively connecting in spaced relationship said adjacent wheel supported frames which connect said first end portions and said adjacent wheel supported frames which connect said second end portions so that said sets of laterally spaced pairs of elongated support members are adapted to move as a unit, and (e) extensible prop means for raising and lowering said wheel supported frames so that the pairs of elongated support members connected thereto are moved into and out of engagement with the mine roof.

2. A mine roof support system as defined in claim 1 in which each of said wheel supported frame carries at least one supporting wheel having a resilient tire adapted for movement on the mine floor.

3. A mine roof support system as defined in claim 1 in which each said connector means extending between and operatively connecting said adjacent wheel supported frames is pivotally connected to said adjacent wheel supported frames so that said adjacent wheel supported frames are articulated for vertical movement relative to each other to thus place said elongated support members in position to conform to the adjacent surface of a mine roof.

4. A mine roof support system as defined in claim 3 in which each said connector means comprises an elongated bar-like member pivotally connected adjacent opposite ends to said adjacent wheel supported frames.

5. A mine roof support system as defined in claim 4 in which stop members are carried by each wheel supported frame at opposite sides of said elongated bar-like member in position to limit relative vertical movement between said wheel supported frame and said elongated bar-like member.

6. A mine roof support system as defined in claim 4 in which each said wheel supported frame has depending side walls spaced laterally from each other for receiving an adjacent end of at least one said bar-like member and a pivot pin extends through said depending side walls and said bar-like member.

7. A mine roof support system as defined in claim 1 in which said extensible prop means comprises depending extensible prop members pivotally connected to each of said wheel supported frames.

8. A mine roof support system as defined in claim 7 in which the pivotal connection between each extensible prop means and its wheel supported frame is in the form of a loose connection so that the lower end of said extensible prop means is adapted for movement relative to a vertical position.

9. A mine roof support system as defined in claim 7 in which each said extensible prop member is pivotally connected adjacent its upper end to its wheel supported frame subjacent the point of connection of its wheel supported frame to an elongated support member.

10. A mine roof support system as defined in claim 7 in which each extensible prop member has a convexly curved upper bearing surface which engages a concave bearing surface carried by its wheel supported frame.

11. A mine roof support system as defined in claim 10 in which said convexly curved upper bearing surface is in the shape of a segment of a sphere.

12. A mine roof support system as defined in claim 7 in which resilient means is interposed between each said prop member and its wheel supported frame in position to urge said prop member toward a generally vertical position.

13. A mine roof support system as defined in claim 12 in which said resilient means comprises angularly spaced spring members interposed between the sides of each said prop member and spring abutments carried by its wheel supported frame.

14. A mine roof support system as defined in claim 1 in which each said elongated support member is connected to its wheel supported frame by an extension support member so that the effective height of the elongated support member relative to its wheel supported frame may be varied.

15. A mine roof support system as defined in claim 14 in which each said extension support member comprises an upstanding member connected adjacent its lower end to its wheel supported frame and connected adjacent its upper end to its elongated support member.

* * * * *